US007737379B2

(12) United States Patent
Witdouck

(10) Patent No.: US 7,737,379 B2
(45) Date of Patent: Jun. 15, 2010

(54) SYSTEM AND METHOD FOR SORTING LARVAE COCOONS

(76) Inventor: Calvin J. Witdouck, Box 65, Iron Springs, Alberta, T0K 1G0 (CA)

( * ) Notice: Subject to any disclaimer, the term of this patent is extended or adjusted under 35 U.S.C. 154(b) by 388 days.

(21) Appl. No.: 11/776,983

(22) Filed: Jul. 12, 2007

(65) Prior Publication Data

US 2008/0017557 A1 Jan. 24, 2008

Related U.S. Application Data

(60) Provisional application No. 60/831,663, filed on Jul. 19, 2006.

(51) Int. Cl.
*B07C 5/346* (2006.01)

(52) U.S. Cl. ..... 209/589; 209/588

(58) Field of Classification Search ..... 209/589, 209/588; 378/58

See application file for complete search history.

(56) References Cited

U.S. PATENT DOCUMENTS

| | | | | |
|---|---|---|---|---|
| 2,532,644 | A * | 12/1950 | Robinson | 378/58 |
| 3,545,610 | A * | 12/1970 | Leonard et al. | 209/579 |
| 3,768,645 | A * | 10/1973 | Conway et al. | 209/565 |
| 4,320,841 | A * | 3/1982 | Gordon et al. | 209/552 |
| 4,324,335 | A | 4/1982 | Conway et al. | |
| 4,666,045 | A | 5/1987 | Gillespie et al. | |
| 4,909,930 | A | 3/1990 | Cole | |
| 4,946,045 | A | 8/1990 | Ditchburn et al. | |
| 5,394,342 | A | 2/1995 | Poon | |
| 5,632,381 | A * | 5/1997 | Thust et al. | 209/44.1 |
| 5,738,224 | A | 4/1998 | Sommer, Jr. et al. | |
| 5,960,104 | A * | 9/1999 | Conners et al. | 382/141 |
| 6,229,872 | B1 * | 5/2001 | Amos | 378/58 |
| 6,757,354 | B2 | 6/2004 | Skatter et al. | |
| 6,778,681 | B2 * | 8/2004 | Garms et al. | 382/100 |
| 7,564,943 | B2 * | 7/2009 | Sommer et al. | 378/53 |

FOREIGN PATENT DOCUMENTS

| | | | |
|---|---|---|---|
| JP | 55026212 A | * | 2/1980 |
| JP | 57095304 A | * | 6/1982 |
| JP | 07003517 A | * | 1/1995 |

* cited by examiner

*Primary Examiner*—Patrick Mackey
*Assistant Examiner*—Luis Gonzalez
(74) *Attorney, Agent, or Firm*—Ade & Company Inc.; Ryan W. Dupuis; Kyle R. Satterthwaite

(57) ABSTRACT

A cocoon sorting system sorts cocoons with healthy larvae therein, for example healthy leafcutter bee cells, from those with non-healthy larvae therein. The system conveys cocoons through a target scanning area on a conveyor where an x-ray source directs x-rays at the cocoons in the target scanning area. An opposing sensor head receives the x-rays which have passed through the target scanning area for generating a density image of cocoons in the target area. A processor compares the density image to a prescribed density criteria and determines a rejected cocoon if the density criteria is not met. A sorting mechanism removes the rejected cocoon from a remainder of cocoons on the conveyor.

13 Claims, 4 Drawing Sheets

SYSTEM AND METHOD FOR SORTING LARVAE COCOONS

This application claims the benefit under 35 U.S.C. 119(e) of U.S. provisional application Ser. No. 60/831,663, filed Jul. 19, 2006.

FIELD OF THE INVENTION

The present invention relates to a system and method for sorting larvae cocoons, for example sorting leafcutter bee cells to separate cells having healthy larvae therein from cells having parasites or other undesirable traits therein. The system and method make use of x-rays to compare internal density characteristics of the cocoons in order to assess whether or not the cocoons have healthy larvae therein.

BACKGROUND

In the leafcutter bee industry a lot of wasted effort and resources are spent raising larvae which are believed to be healthy, but which in fact have been spoiled by parasites or are otherwise defective.

Known problems which interfere with healthy larvae in leafcutter bee cells include parasites, chalkbrood disease, pollen balls and other undesirables including stored pests and predators, dead larvae, $2^{nd}$ generation, dead prepupae and damaged cells as described in the following:

Parasites: These are the #1 problem for the leafcutter bee industry

Prior art solution: We use insecticides during the incubation stage to try and control them before the bees emerge from there cells. Some of the difficulties with this is the insecticides are not healthy to work with.

Dichlorvos (the insecticide most widely used) is a known potential carcinogen in the U.S. and may be removed from the market at anytime by the environmental pest control agency.

Konk which is the other pesticide used, has questionable control and requires airflow systems which are very costly to install and are hard to put into existing incubation facilities.

Both types of insecticides cause healthy bee mortality regardless of how well they are used.

The Bee mortality that results from the use of these chemicals can be upwards of 50% if not controlled and aired out properly and even when done properly there is always a certain mortality every year.

It is desirable to remove 100% of the parasites in the larvae state during winter processing procedures and eliminate all previous methods of control. This alone would be a major breakthrough for the industry. We would have 0 mortality due to chemical residues or reparasitism. This would be a major financial benefit to the industry.

Chalkbrood disease: A fungus that infects healthy larvae.

It is further desirable to remove the chalkbrood cadavers and moldy cells during the winter storage period of the larvae.

Note: Fumigation would still be required due to spores within the cell mass, but they will be drastically reduced and the infestation levels should be much lower.

Some markets require 100% chalkbrood free samples or they are unacceptable. The process we are proposing could bring us to undetectable levels for these markets and also give us the ability to break into new markets with higher standards.

Pollen Balls: These are Pollen Masses that look like a good bee cell from the outside, but they are just masses of pollen on the inside.

They do not cause any adverse effects but can amount up to 50% of the total volume of product we are working with.

It is also desirable to remove the Pollen Balls.

This would decrease our incubation space required plus that percentage of related equipment ie. incubation trays, racks and storage space. It would make the overall operation much more efficient.

It is estimated that we are using 33% more space and equipment then we would have to if we could remove 99% of the unwanted cell mass. This would mean that we could immediately increase our incubation capacity of existing facilities by 33%.

Stored Pests and predators, dead larvae, 2nd Generation, dead prepupae and damaged cells.

These are other negative products that can potentially be removed from the healthy larvae.

In view of all these problems it is clearly desirable to sort the larvae cocoons if possible to avoid the wasted resources which are commonly spent. In the prior art, various devices are known for performing some form of sorting, for instance as described in U.S. Pat. Nos. 6,757,354; 4,324,335; 4,666,045; 4,909,930; 4,946,045; 5,394,342; 5,738,224. None of these prior art references however can be suitably arranged to accommodate larvae cocoons so as to distinguish between good cocoons with healthy larvae and bad defective cocoons.

SUMMARY OF THE INVENTION

According to one aspect of the invention there is provided a system for sorting larvae cocoons comprising:

a conveyor for conveying cocoons through a target scanning area;

an x-ray source for directing x-rays at the target scanning area;

a sensor head opposite the x-ray source in relation to the target scanning area for receiving x-rays which have passed through the target scanning area and for generating a density image of a cocoon in the target area;

a processor for comparing the density image to a prescribed density criteria of the processor and for determining a rejected cocoon if the density criteria is not met;

a sorting mechanism for removing the rejected cocoon from a remainder of cocoons on the conveyor.

According to a second aspect of the present invention there is provided a method of sorting larvae cocoons comprising:

conveying cocoons through a target scanning area;

providing an x-ray source adjacent the target scanning area;

directing x-rays at the target scanning area from the x-ray source;

providing a sensor head opposite the x-ray source in relation to the target scanning area;

generating a density image of a cocoon in the target area based on x-rays received by the sensor head and which have passed through the target scanning area;

comparing the density image to a prescribed density criteria;

determining a rejected cocoon if the density criteria is not met;

removing the rejected cocoon from a remainder of cocoons.

By providing a system which is capable of generating a density image and which makes use of density criteria to which the density image can be compared, it is possible to assess whether or not healthy larvae is present in larvae cocoons to considerably reduce the resources otherwise wasted.

When the processor is arranged to identify a region of density different than an outer shell of the cocoon, the prescribed density criteria may comprise an average shape image. There may be provided a plurality of different shape images corresponding to different views of the cocoon.

When the processor is arranged to identify a region of density differing from an outer shell of the cocoon, the prescribed density criteria may comprise an overall size of the region. The prescribed density criteria includes an upper size limit and/or a lower size limit.

When the processor is arranged to identify a region of density differing from an outer shell of the cocoon, the prescribed density criteria may comprise a required consistency of density throughout the region.

When the processor is be arranged to identify a region of density differing from an outer shell of the cocoon, the prescribed density criteria may comprise identifying distinct regions different in density from one another.

When the processor is arranged to identify a region of density differing from an outer shell of the cocoon, the prescribed density criteria may comprises an overall permissible density range of the region.

The density image may comprises a two-dimensional image.

The density image preferably represents an overall through mass of the cocoon.

The sensor head may be arranged to generate a density image of the cocoon in its entirety prior to the processor comparing the density image to a prescribed density criteria.

The conveyor may be arranged to convey the cocoons in a single layer thickness thereon.

The conveyor may be arranged to convey the cocoons thereon spaced apart from one another so that the cocoons do not touch one another.

There may be provided a mechanism for pre-sorting non-cocoon debris from the cocoons prior to conveying the cocoons through the target scanning area.

There may be provided a sorting screen in series with the conveyor for sorting non-cocoon debris from the cocoons to be conveyed on the conveyor.

The prescribed density criteria may comprise distinguishing criteria between cocoons comprising leafcutter bee cells with healthy larvae therein and leafcutter bee cells having non-healthy larvae therein.

When a transfer system is arranged to transfer cocoons from a source area to the conveyor, the transfer system preferably comprises an endless perforated belt rotatably supported so that a portion of the belt is exposed to an internal vacuum pressure and spans from the source area to the conveyor.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
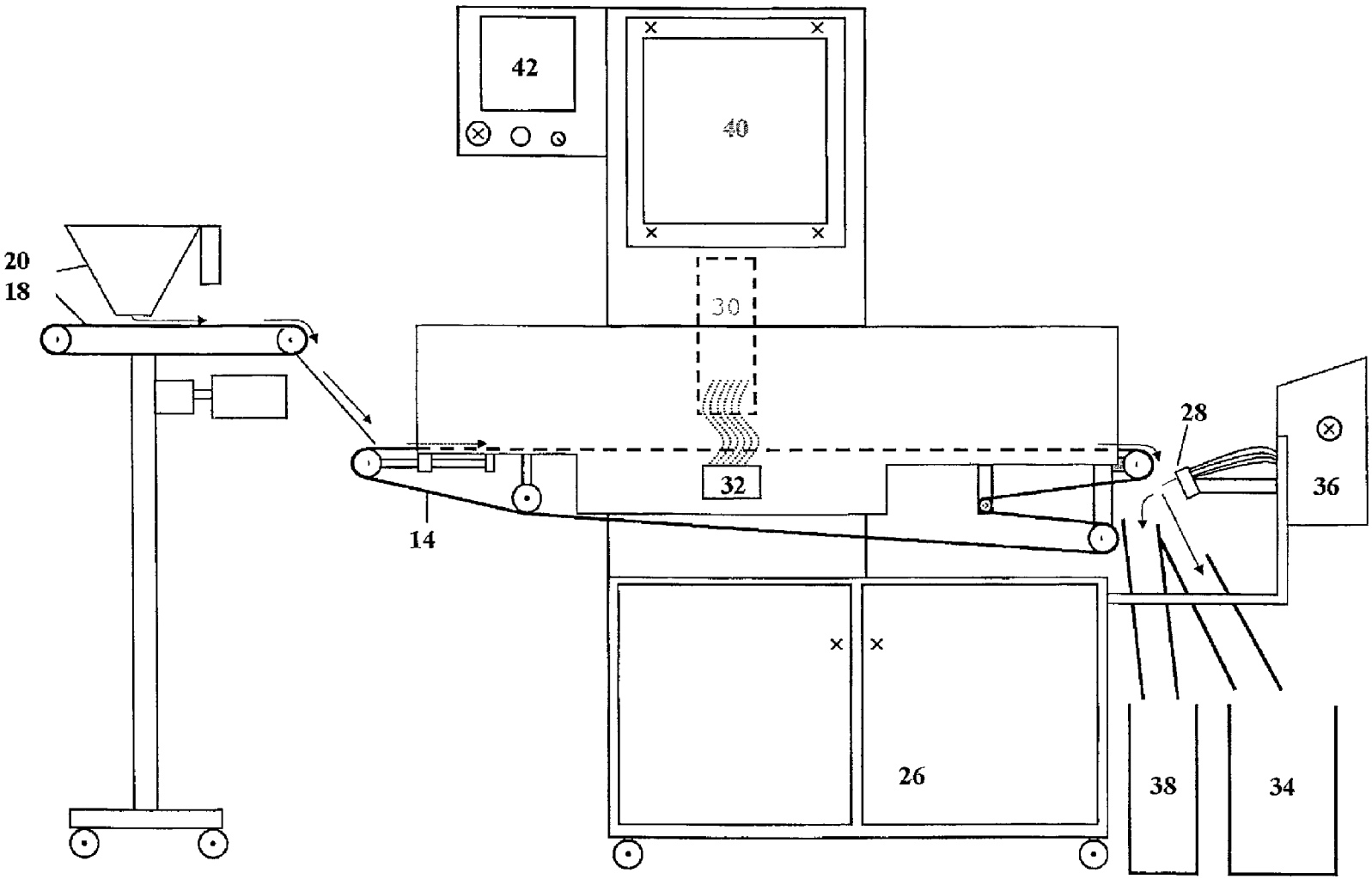
FIG. 1 is an overall schematic view of the larvae cocoon sorting system.

Referring to the accompanying figures there is illustrated a larvae cocoon sorting system generally indicated by reference numeral 10. The system 10 is particularly suited for sorting larvae cocoons, for example leafcutter bee cells 12 which are desirably sorted between cells containing healthy larvae and rejected cells containing parasites, pollen masses, or other non-healthy larvae type debris.

The system includes an inspection conveyor 14 comprising an endless belt which is rotated to convey cocoons supported thereon through a target scanning area 16. The cocoons are in turn scanned by x-rays at the target scan area to obtain a density image associated with each cocoon to later determine if the cocoon should be accepted or rejected.

In a first embodiment as shown in FIG. 1, a feeding system is shown in which the cocoons first start out at an inlet hopper 18 which includes a vibrator 20 coupled thereto to dispense the cocoons in a relatively even manner therefrom on a feed conveyor 22. The feed conveyor 22 similarly comprises an endless belt driven to rotate so that the cocoons are spread out across a flat top side of the belt as it rotates. The conveyor 22 feeds the cocoons onto a transfer screen 24 which is sloped downwardly and laterally outwardly from one end of the feed conveyor 22 to a proximate end of the inspection conveyor 14 positioned therebelow. The transfer screen 24 permits the pre-sorting of non-cocoon debris so that only cocoons are deposited on the inspection conveyor 14. The transfer screen 24 terminates in close proximity to the top surface of the inspection conveyor 14 to deposit the cocoons on the top side of the inspection conveyor 14 in a single layer with the cocoons evenly spread apart so that no cocoons are touching one another.

In all embodiments, the inspection conveyor 14 is speed controlled with the speed being known and recorded by a computer 26 controlling operation of the system. The computer 26 uses this speed information to track the positions of the various cocoons thereon from the target scan area 16 to a sorting area 28 at the end of the inspection conveyor 14 opposite the feed conveyor 22.

Scanning is performed at the target scan area at approximately mid-length along the inspection conveyor. An x-ray source 30 is mounted overhead of the conveyor to direct x-rays downwardly through the cocoons on the conveyor in the target scanning area. A sensor head 32 is mounted below the conveyor so as to be opposite the x-ray source 30 in relation to the target scan area. The sensor head 32 receives the x-rays which have passed through the cocoons in the target scan area and is arranged to generate a density image of each cocoon. The density image comprises a two-dimensional image of an overall through mass of the cocoon with the density image for each cocoon being generated in its entirety prior to the image being evaluated by the processor of the computer controller 26. Once the density images are sent to the processor, the processor compares the image to various density criteria.

The density criteria includes an overall density range so that if parts of the cocoon are much denser or much less dense than the expected density range for a healthy larvae, the cocoon is rejected.

The density criteria also includes sizing criteria for areas having a different density than the remaining cocoon. The processor thus first identifies regions of varying density from the surrounding outer shell of the cocoon and which are within the acceptable density range. Once these regions are identified, the overall shape thereof is compared to various average shape images in which each shape image represents either an average front view, and average end view or an average profile view of a particular cocoon with a healthy larvae. If the shape of the region of different density does not match closely enough to one of the acceptable views of a healthy larvae of the computer, the cocoon is also rejected.

The density criteria also includes criteria for the overall size of the area of differing density including upper and lower size limits. If the overall size of the region of different density is below the lower limit or above the upper limit considered acceptable for healthy larvae, the cocoon is also rejected.

Finally the density criteria includes evaluating the overall consistency of density throughout a region of density different than the surrounding outer shell of the cocoon as the cocoon will be rejected if there are plural distinct density regions separate from one another or if the density is discontinuous throughout a given region.

Once a rejected cocoon has been identified by the computer 26, the computer tracks the location of the rejected cocoon along the conveyor using the known speed information of the conveyor. The cocoons are directed to fall off the end of the conveyor at the sorting area 26 in a sheet like pattern of single layer. The sheet of falling cocoons is directed automatically to a collection area 34 designated for healthy larvae if there is no interference by the sorting mechanism. A plurality of pneumatic valves 36 are provided in the sorting mechanism which control an array of nozzles aligned with the rows of falling cocoons. The valves and nozzles are arranged so that when they are actuated, a blast of air is released from a selected one of the nozzles by the appropriate pneumatic valve 36 to cause a rejected one of the cocoons to be redirected away from its usual path to the collection area 34 and instead redirect the rejected cocoon into a rejection area 38.

Controls for the system are configurable through an operator interface including a display screen 40 to display information to the user and a touch screen 42 permitting information to be input into the computer. A conventional keyboard and mouse can also be provided for inputting information into the computer.

Figure 2:
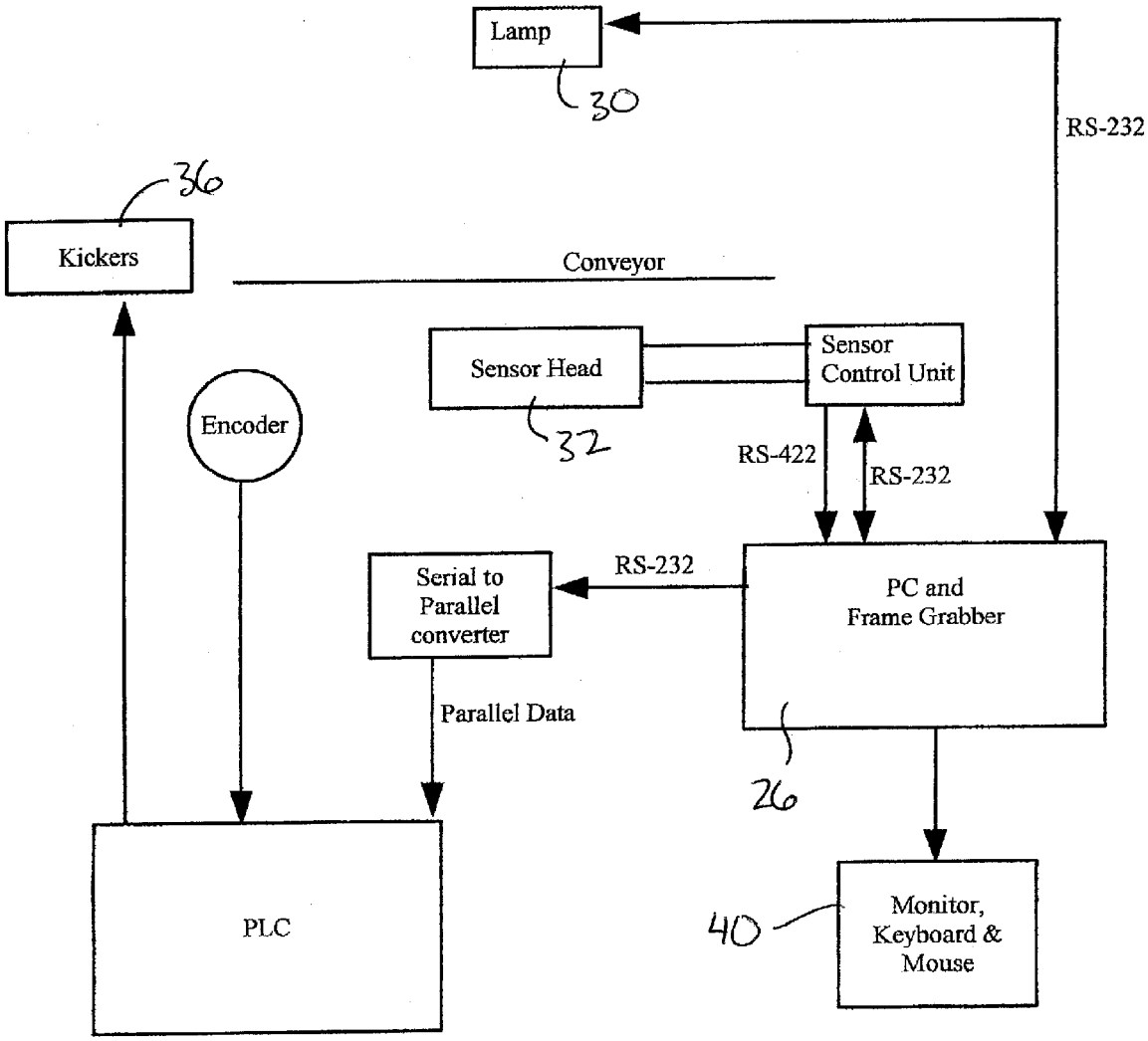
FIG. 2 is an overall schematic view of the electronic connections between various components of the system.

As shown in FIG. 2 the computer controller 26 communicates with the lamp of the x-ray source 30 as well as the sensor control unit of the sensor head 32 for safe operation and collection of the x-rays. The computer 26 also communicates with a programmable logic controller (PLC) which controls the various operations of the system including the kickers in the form of the pneumatic valves 36 of the sorting mechanism.

Figure 4:
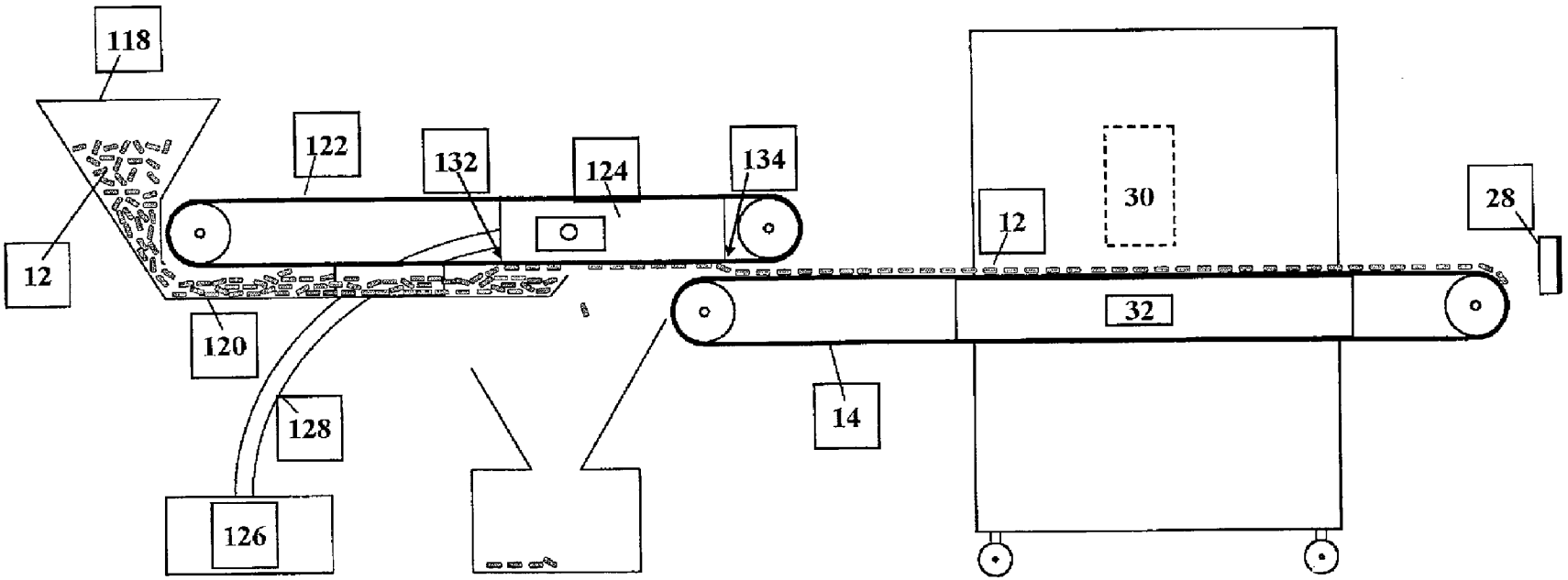
FIG. 4 is a schematic view of an alternate embodiment of a feeding system for use in the sorting system according to FIG. 1.

Turning now more particularly to FIG. 4, a second embodiment of the feeding system for depositing the cells evenly across the inspection conveyor 14 is shown. According to the second embodiment of the feeding system, an inlet hopper 118 is provided for initially receiving the cells therein. An open bottom end of the hopper communicates with a tray 120 across which the cells are distributed. A pickup conveyor 122 is mounted above the tray 120 in close proximity thereto. The pickup conveyor connects between the tray 120 and the starting end of the inspection conveyor 14. The pickup conveyor 122 comprises an endless perforated belt supported so that an underside of the belt spans generally horizontally between the tray 120 and the inspection conveyor 14.

A vacuum chamber 124 is mounted to communicate with an interior side of the pickup conveyor 122. The vacuum chamber is maintained at a reduced vacuum pressure by action of a vacuum supply 126 communicating with the vacuum chamber 124 through a suitable vacuum hose 128. The vacuum chamber 124 communicates with the interior side of the belt forming the pickup conveyor along with bottom side thereof spanning between the tray 120 and the staring end of the inspection conveyor 14. In this manner air is continually drawn into the vacuum chamber through the perforations in the underside of the belt so as to cause cells to be held by suction to the underside of the pickup conveyor 122. The vacuum chamber 124 is contained within the conveyor frame and communicates with the vacuum hose through a vacuum inlet 130.

The vacuum chamber 124 is bound by a first wall 132 at one end of the chamber and a second wall 134 at a second end of the chamber which abut the inner side of the belt forming the pickup conveyor 122. Accordingly, the belt is only exposed to the vacuum pressure once it is rotated passed the first wall overtop of the tray and only until it rotates up to the second wall 134 above the starting end of the inspection conveyor 14. The belt of the conveyor 122 spans from the first wall 132, in the direction of rotation of the conveyor, above the tray for a horizontal distance before reaching a terminal edge of the tray to provide sufficient contact time with the belt and the cells in the tray 120. This ensures that cells are collected by each of the perforations in the belt.

Each perforation is intended to hold a single cell thereon at a desired spacing from adjacent perforation supporting cells thereon so that the resulting cell spacing when deposited on the inspection conveyor is ideal for monitoring by the x-ray source and camera 32. The belt of the pickup conveyor also spans horizontally a distance over the starting end of the inspection conveyor before reaching the second wall 34 where suction is no longer applied to the belt so that the cells fall by action of gravity from the pickup conveyor 122 to the inspection conveyor 14. The pickup conveyor 122 and the inspection conveyor 14 are positioned close enough to one another in a vertical direction that the cells only fall in the order of half an inch from one belt to the other for optimal placement on the inspection conveyor 14.

The vacuum conveyor is used to transfer the leafcutter bee cells onto the inspection conveyor with precise accuracy to minimize the cells contacting each other on the inspection conveyor for more accurate vision processing and efficiency.

The cells are fed to the perforated vacuum conveyor via a hopper or a transfer conveyor suspended under the vacuum conveyor. When the cells are within the vacuum zone of the conveyor they are sucked up to perforated holes in the belt and held there until they reach the vacuum cutoff point where they are released and dropped onto the vision conveyor. They drop approximately 0.50 inch so there is very little movement once they drop onto the inspection belt which minimizes the cells touching each other on the belt to maximize the vision systems capabilities.

The perforations in the belt are designed specifically for this process and are sized and spaced for maximum capacity for the vision belt to handle. It is designed with a variable speed motor to match belt speeds with the vision belt.

Figure 3:
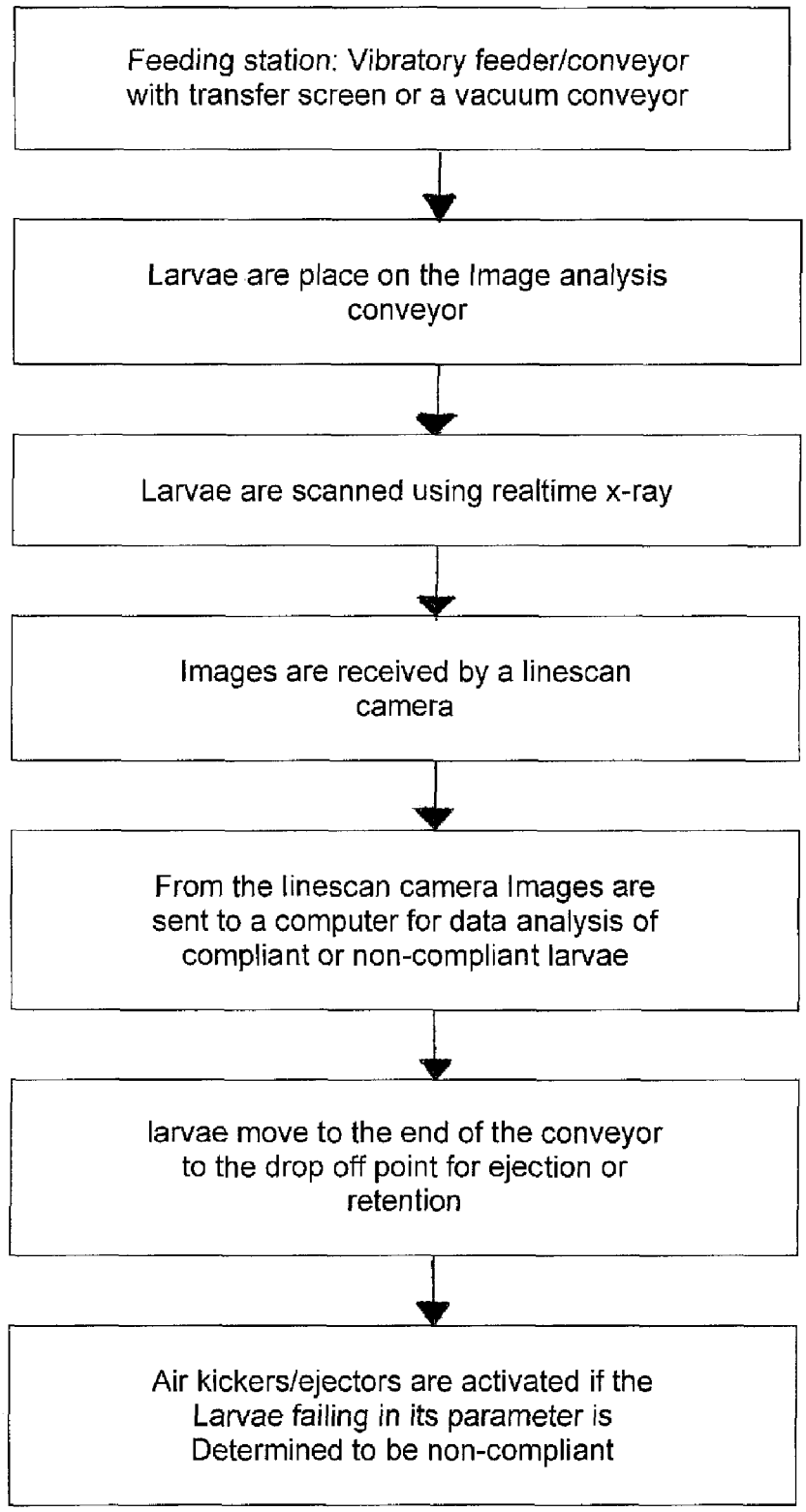
FIG. 3 is a flow chart illustrating the various steps in the method according to the present invention.

The overall steps of the method of sorting described herein are shown in schematic form in FIG. 3.

Operation of the system includes the following functions:

Key Switch, and Turning the Machine ON: To prevent the operation of this machine without the knowledge and presence of an authorized radiographer the main electrical circuit is fitted with a key switch:

With the key switch turned to the OFF position: The key tray be removed; the UPS will be on charge, if the 120V line-cord is properly connected; the computer equipment may be operated, if there is sufficient charge in the UPS.

With the key switch turned to the MAINTENANCE position: The key may be removed; most of the equipment, x-ray generator excluded, maybe operated for the purposes of maintenance, sanitation arid troubleshooting.

With the key switch turned to the PRODUCTION position: The key may not be removed, the orange (x-ray permissive) light will come on, and a certified radiographer must be in attendance. Full access to all operating functions is available.

Independent of the Key Switch, in order to run the system:

1) The machine may have to be plugged into the power sources: 120V AC electrical, 240V AC electrical and 60 to 120 PSIG Air.

2) The Computer may have to be turned on.

3) The Motors may have to be plugged in: Infeed-Conveyor (240V 3Ø AC twist-lock) and Hopper-Vibrator (120V AC twist-lock).

4) The interface signals for the take-away system may have to be connected: Motor Run/Stop signal; Bin-Present signal; (Additional power connections for the customer-supplied portions of the take-away system also may be required.)

5) The x-ray permissive circuit must be complete: Emergency Stops must be primed; Rear upper door must be closed; Conveyor access panel must be secured.

The computer will, automatically on power-up, run the Bee Inspection Program. If the computer is running, and this program has been quit, it will have to be restarted. This may be done from a convenient desk-top icon.

Most of the operator's interface with this machine is done through the 'Human-Machine Interface' (HMI), the smaller panel on the left; of the machine.

After the physical, electrical, and pneumatic setup of the machine, the Key Switch may be turned to the 'Production' mode. As the switch is turned from 'Off' to 'Maintenance,' and from 'Maintenance' to 'Production,' you may hear the electrical contactors pulling in, first 'MI,' which powers the motors and the kickers, and second, 'M2,' which powers the x-ray generator.

At the HMI: Select "Production" and ensure the number of bees per batch is correct for current production; Launch the inspection software on the PC, turn on the x-ray lamp, and initiate the production module.

The overall process of this machine is controlled by a Programmable Logic Controller (PLC). The operator's interface with the PLC is through the HMI. The PLC communicates with the PC, which runs the x-ray subsystem, and evaluates the images it receives.

The PC is able to identify, and communicate to the operator (via the PC monitor), the following conditions:

1) Normal Conditions: Location of cocoons and other objects to be rejected.

2) Abnormal Conditions: Problems in the x-ray generation circuit, including: Safety Circuit not complete, Inadequate Cooling.

3) Production Statistics, including: Number of bins produced, since reset; Number of bees processed, since reset; Machine lifetime number of bees processed.

The PC is able to identify, and communicate to the operator (via the HMI), the following conditions:

1) Normal Conditions: The passage of the target number of bees in a lot.

2) Abnormal Conditions: Excessively high reject rate.

The PLC is able to identify, and communicate to the operator the following conditions:

1) Normal Conditions: The accumulation of the target number of bees in a lot into the completed product bin (communicated via instructing the completed product take-away to stop).

2) Abnormal Conditions (communicated via the HMI): Multiple, un-handled Completed Product Bin change commands; Loss of communication with PC; Improper rate of data from the PC (including quitting of vision program); Improper speed of inspection conveyor (including conveyor stopped); Various conditions which prevent the x-ray lamp from being used (some of these error codes may require the operator to refer to the PC for further information).

Initiating Bee Inspection

Initiating the Bee inspection program may involve turning the computer on, and entering the user password. If the computer is already running, the Bee inspection program may be running, or it may have to be started, which is easily done from a convenient desk-top shortcut.

Running the Bee Inspection Program

To inspect bees the x-ray system must be running. This requires full electrical power to the machine (and air power, if defects are to be rejected—there is no fault-checking against loss of air). The emergency stops and other components of the x-ray permissive circuit must be properly enabled.

Controlling the Flow of Bees

To maintain system efficiency, the flow of cocoons must be well regulated. If the flow is too slow, production quotas will not be met. If the flow is too high the false reject rate will be high, and there is (at extreme values) the risk, again, that the production quotas will not be met. Furthermore, cocoons, as they land onto the inspection conveyor, should maintain separation in order to minimize the false reject rate.

| There are seven basic variables in the flow control: | Factory-Recommended Setting |
|---|---|
| 1) Depth of cocoons in hopper, | Full to near empty |
| 2) Eccentricity setting of vibrator, | Minimum |
| 3) Speed of conveyor under hopper, | 30 Hz, on VFD |
| 4) Speed of vibrator on hopper, | 40% on potentiometer |
| 5) Height of discharge gate at outlet of hopper, | 7/16 inch above belt |
| 6) Slope of transfer screen, | 40° |
| 7) Height of transfer screen above inspection belt. | 1/8 inch |

The 'Factory Recommended Setting' data in the above table is provided as a guide to help restore performance in the case where many parameters have been adjusted and proper performance cannot be achieved.

Of these settings, the first (depth of cocoons in hopper) has minimal effect, except at extreme low values. The second (eccentricity setting of vibrator) is internal to the vibrator and has been factory set to a minimum value. It likely does not need changing. The next three variables (conveyor speed, vibrator speed, and gate height) are your main controls for the flow rate equation.

In addition to maintaining an appropriate flow rate, it is also essential to achieve a well controlled transfer onto the inspection belt. The cocoons should land onto the inspection conveyor with zero relative horizontal speed. By doing so, their spacing from the hopper conveyor will be amplified by the speed difference of the two belts. By failing to do so, the momentum of the cocoons will cause them to skid along the inspection conveyor, whereupon they will likely collide with other cocoons, and thus generate doubles which degrades system throughput.

Operational Settings

To achieve optimum performance the conveyor transporting bees through the inspection station must be operating at a speed of about 10 inches per second. This is achieved at an input frequency setting on the order of 50.8 Hz. In 'Production' mode, the PLC monitors this speed, and will advise the operator if the belt is not moving, within limits, at the proper speed. In one of the 'Maintenance' modes, the PLC monitors this speed, and if it is not properly set provides more explicit details.

Starting Production

Before starting production, the equipment must be fully and properly plugged in, and the Key Switch turned to Production mode.

Setup at the PLC

If the PLC screen is in screen-saver mode, touch the screen for a second or so; to 'wake' it.

Front the Main Screen, select "Production Mode", and verify that the number of bees in a lot is properly set. If the "Production Mode" button is not displayed select "Back".

If the Number of bees in a lot is not properly set: Exit from Production mode; Select Maintenance Mode: Select the Bees/Bag value; Key in the correct value, and Enter it; and Return to "Production Mode".

Setup at the PC

If it is not already running: Launch the Bee Inspector Program. Note that this program can take from five to fifteen (5 to 15) seconds to launch. To reduce frustration, you should not make multiple, consecutive, attempts to launch it.

A 'Dark Correction' button permits a Dark Correction function to be executed.

Open the x-ray lamp nodal. Address status issues, if any, highlighted in red (all status areas should show green). Select "RX ON" to turn on the lamp. The equipment x-ray warning lamps should come on. Wait for the lamp to warm up. This should be complete within 40 seconds. Although there is no indicator of it being complete, the time may be counted off by referring to the clock on the PLC screen. (Since the lamp is operated at a relatively low voltage, the staged warm-up cycle discussed in the lamp manual need not be performed.) Exit the Lamp nodal by clicking on "OK".

A "Light Correction" button permits a Light Correction function to be executed. It will also be seen that the image changes front black to near white.

Running Bee Inspection

After exiting other modes, at the PC, click on the 'Production' icon. The Bee Inspection program will show "[ERROR] ", but this may be ignored at the moment.

At the PLC, select "Start". The conveyors will run, and the Bee Inspection program on the PC will show 'Production Mode'. The image will show the belt and (if any) the bees passing. The digitized version of the image will show the defects (if any) passing, and the kickers will fire accordingly.

The present invention includes the following feeding features: For this sorter we have developed a feeding system that incorporates gentle handling, and also the removal of loose debris to maximize throughput of the imaging section. Our feeder provides us with reasonably even flow, and also with adequate spacing for the vision subsystem to discriminate objects and for the kicker subsystem to target individual objects.

Two embodiments of the feeding system are shown in the accompanying figures and described below in which each provides a design which distributes them evenly across the width of the processing system. In one embodiment there is provided a transfer system arranged to transfer cocoons from a source area to the conveyor, the transfer system comprising an endless perforated belt rotatably supported so that a portion of the belt is exposed to an internal vacuum pressure and spans from the source area to the conveyor.

With the cocoons placed in the vibratory hopper we will be using the combined adjustments of the belt speed and hopper discharge clearance to adjust the flow rate. At this point the cocoons will be spread uniformly across the full width of the belt. The cocoons will travel over the head pulley of this feeder conveyor, over a screen where the trash will drop out, and onto the vision conveyor. In sliding, the cocoons will be constrained to a width of twelve inches and their density will be fairly uniform across the width of the vision belt.

The x-ray system will image the load on the conveyor, identify objects to be removed, and communicate the position of these to the PLC. We have developed CUSTOM SOFTWARE for this image processing application. In normal operation, including various test modes, it communicates with the PLC, and thus can be controlled through the HMI. (Human-machine interface)

The PLC will track belt motion, and command the kickers to remove the target objects to be rejected at the appropriate time. Our target capacity at this time is 75 cells/sec minimum.

The PLC will monitor the conveyor speed, to ensure the imaging system is receiving data that is not stretched by a slow conveyor speed, nor cramped by a fast one. It will also monitor the data rate from the PC, to guard against information loss.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A system for sorting larvae cocoons comprising:

a conveyor arranged for conveying cocoons through a target scanning area;

an x-ray source arranged for directing x-rays at the target scanning area;

a sensor head opposite the x-ray source in relation to the target scanning area so as to be arranged for receiving x-rays which have passed through the target scanning area and arranged for generating a density image of a cocoon in the target area comprising a two-dimensional density image representing an overall through mass of the cocoon;

a processor arranged for comparing the density image to a prescribed density criteria of the processor and arranged for determining a rejected cocoon if the density criteria is not met;

the processor being arranged to identify a region of density different than an outer shell of the cocoon;

the prescribed density criteria comprises at least one average shape criteria, an overall size criteria including a lower size limit, and a consistency criteria comprising a required consistency of density throughout said region of density different than the outer shell;

the processor being arranged to determine a healthy cocoon if said region of density different than the outer shell of the cocoon has a shape which matches said at least one average shape criteria, has a size which is greater than the lower size limit so as to match the overall size criteria, and has a consistent density which matches the consistency criteria;

the processor being arranged to determine a rejected cocoon if said region of density different than the outer shell of the cocoon has a shape which does not correspond to said at least one average shape criteria, has a size which does not correspond to the overall size criteria, or has a discontinuous density; and a sorting mechanism arranged for removing the rejected cocoon from a remainder of cocoons on the conveyor.

2. The system according to claim 1 wherein the density criteria comprises a plurality of different shape criteria corresponding to different views of the cocoon.

3. The system according to claim 1 wherein the prescribed density criteria includes an upper size limit.

4. The system according to claim 1 wherein the prescribed density criteria comprises identifying distinct regions different in density from one another.

5. The system according to claim 1 wherein the prescribed density criteria comprises an overall permissible density range of the region.

6. The system according to claim 1 wherein the sensor head is arranged to generate the density image of the cocoon in its entirety prior to the processor comparing the density image to a prescribed density criteria.

7. The system according to claim 1 wherein the conveyor is arranged to convey the cocoons in a single layer thickness thereon.

8. The system according to claim 1 wherein the conveyor is arranged to convey the cocoons thereon spaced apart from one another so that the cocoons do not touch one another.

9. The system according to claim 1 wherein there is provided a mechanism for pre-sorting non-cocoon debris from the cocoons prior to conveying the cocoons through the target scanning area.

10. The system according to claim 1 wherein there is provided a sorting screen in series with the conveyor for sorting non-cocoon debris from the cocoons to be conveyed on the conveyor.

11. The system according to claim 1 wherein the prescribed density criteria comprises distinguishing criteria between cocoons comprising leafcutter bee cells with healthy larvae therein and leafcutter bee cells having non-healthy larvae therein.

12. The system according to claim 1 wherein there is provided a transfer system arranged to transfer cocoons from a source area to the conveyor, the transfer system comprising an endless perforated belt rotatably supported so that a portion of the belt is exposed to an internal vacuum pressure and spans from the source area to the conveyor.

13. A method of sorting larvae cocoons comprising:

conveying cocoons through a target scanning area;

providing an x-ray source adjacent the target scanning area;

directing x-rays at the target scanning area from the x-ray source;

providing a sensor head opposite the x-ray source in relation to the target scanning area;

generating a density image of a cocoon in the target area based on x-rays received by the sensor head and which have passed through the target scanning area such that the density image comprises a two-dimensional density image representing an overall through mass of the cocoon;

identifying in the density image a region of density different than an outer shell of the cocoon;

comparing said region of the density image to a prescribed density criteria comprising at least one average shape criteria, an overall size criteria including a lower size limit, and a consistency criteria comprising a required consistency of density throughout said region of density different than the outer shell;

determining a healthy cocoon if said region of density different than the outer shell of the cocoon has a shape which matches said at least one average shape criteria, has a size which is greater than the lower size limit so as to match the overall size criteria, and has a consistent density which matches the consistency criteria;

determining a rejected cocoon if said region of density different than the outer shell of the cocoon has a shape which does not correspond to said at least one average shape criteria, has a size which does not correspond to the overall size criteria, or has a discontinuous density; and removing the rejected cocoon from a remainder of cocoons.

* * * * *